US010144621B2

(12) United States Patent
Braun et al.

(10) Patent No.: US 10,144,621 B2
(45) Date of Patent: Dec. 4, 2018

(54) METHOD AND DEVICE FOR OPERATING A MOBILE CRANE AND MOBILE CRANE

(71) Applicant: Terex Global GmbH, Schaffausen (CH)

(72) Inventors: Matthias Braun, Gersheim (DE); Stefan Maass, Illingen (DE); Markus Stöhr, Schwalbach (DE); Matthias Roth, Waldmohr (DE); Heiko Heintz, Zweibrücken (DE)

(73) Assignee: Terex Global GmbH (CH)

( * ) Notice: Subject to any disclaimer, the term of this patent is extended or adjusted under 35 U.S.C. 154(b) by 156 days.

(21) Appl. No.: 15/332,359

(22) Filed: Oct. 24, 2016

(65) Prior Publication Data

US 2017/0036894 A1 Feb. 9, 2017

Related U.S. Application Data

(63) Continuation of application No. PCT/EP2015/058525, filed on Apr. 20, 2015.

(30) Foreign Application Priority Data

Apr. 22, 2014 (DE) ..... 10 2014 105 618

(51) Int. Cl.

| | |
|---|---|
| ***B66C 23/90*** | (2006.01) |
| ***B66C 23/36*** | (2006.01) |
| ***B66C 13/16*** | (2006.01) |
| ***B66C 13/18*** | (2006.01) |

(52) U.S. Cl.

CPC ..... *B66C 23/905* (2013.01); *B66C 13/16* (2013.01); *B66C 13/18* (2013.01); *B66C 23/36* (2013.01)

(58) Field of Classification Search

CPC ..... B66C 23/905; B66C 23/36; B66C 13/16; B66C 13/18

USPC ..... 701/50

See application file for complete search history.

(56) References Cited

FOREIGN PATENT DOCUMENTS

| | | | | |
|---|---|---|---|---|
| DE | 19933917 | A1 | | 2/2000 |
| DE | 202010014310 | U1 | * | 10/2010 |
| DE | 202010014310 | U1 | | 1/2012 |
| DE | 102012011726 | A1 | | 12/2013 |
| EP | 0539207 | A1 | * | 4/1993 |
| EP | 1 025 585 | A1 | | 8/2000 |
| EP | 1 444 162 | B1 | | 11/2005 |
| EP | 1 925 586 | B1 | | 5/2008 |
| EP | 2 674 384 | A1 | | 12/2013 |

(Continued)

OTHER PUBLICATIONS

Notification of Reasons for Refusal of Japanese Patent App. No. 2016-564080 dated Oct. 10, 2017.

*Primary Examiner* — Brian P Sweeney

(74) *Attorney, Agent, or Firm* — Mayback & Hoffman, P.A.; Gregory L. Mayback

(57) ABSTRACT

A method of operating a mobile crane with a boom includes the steps of determining maximum permissible loads for a plurality of positions in a predetermined position range of the boom, determining a load limit and/or one or more load ranges based on a suspended load and on the maximum permissible loads for the plurality of positions of the predetermined position range of the boom, and operating the mobile crane dependent upon the load limit and/or the one or more load ranges. The load limit can be a local load limit and the one or more load ranges can be one or more local load ranges.

16 Claims, 4 Drawing Sheets

(56) References Cited

FOREIGN PATENT DOCUMENTS

| | | | |
|---|---|---|---|
| JP | 1991-130291 | U | 12/1991 |
| JP | 2002-250055 | A | 6/2002 |

* cited by examiner

METHOD AND DEVICE FOR OPERATING A MOBILE CRANE AND MOBILE CRANE

CROSS-REFERENCE TO RELATED APPLICATIONS

This is a continuing application, under 35 U.S.C. § 120, of copending international application No. PCT/EP2015/058525, filed Apr. 20, 2015, which designated the United States and was not published in English; this application also claims the priority, under 35 U.S.C. § 119, of German patent application No. 10 2014 105 618.3, filed on Apr. 22, 2014, the prior applications are herewith incorporated by reference in their entireties.

STATEMENT REGARDING FEDERALLY SPONSORED RESEARCH OR DEVELOPMENT

Not Applicable

FIELD OF THE INVENTION

The present systems, apparatuses, and methods lie in the field of mobile cranes. The present disclosure relates to mobile cranes with variable support geometries. The present systems, apparatuses, and methods further relate processes for determining a maximum load capacity, measures for ensuring the stability of the mobile crane, and measures for displaying safe operating positions.

BACKGROUND OF THE INVENTION

To improve the stability and to increase the load capacity, mobile cranes are usually provided with supporting measures. Such supporting measures comprise support bars protruding at the sides of the mobile crane, the support extensions being provided with support cylinders. By means of the support cylinders, a distal end may be supported on a ground area of the mobile crane to thereby enlarge the effective standing area. With the enlarged effective standing area, the load capacity, i.e., the maximum permissible load of the mobile crane can be improved.

Furthermore, to determine the load capacity, i.e., the maximum permissible load on the boom, load tables are provided in which the maximum permissible load is specified for each configuration of the mobile crane based on the possible degrees of freedom. In particular, the load tables consider the length and configuration, respectively, as well as the angle of rotation of the boom (usually 0-360°). The map-based determination of the maximum permissible load based on the load tables may be further supplemented by function-based models taking into account further parameters and which, e.g., consider the load capacity of the load rope.

Particularly for operation of the mobile crane on a narrow footprint, the support extensions may not be fully extended for use of the mobile crane, thus resulting in an asymmetrical support geometry of the resulting support positions. For mobile cranes with preset support geometries, in particular, when used with fully extended support extensions, the determination of the maximum permissible load can be sufficiently performed using conventional load tables in a known manner. However, in mobile cranes with variable support geometry, it is further necessary to consider the actual support positions of the mobile crane for determination of the maximum permissible load.

For scheduling, the maximum load capacities are usually provided as depending on various parameters, in particular on the load radius, as well as depending on the respective configuration. A crane operator can determine the operation of the crane, in particular, the configuration and possible lifting lengths of a load to be carried, before operation starts. For example, a mobile crane is disclosed in European Patent EP 1 444 162 B1 to Frankenberger et al., in which in an electronic control unit an operation area can be graphically displayed on a display based on one of the parameters of load and load radius as well as measure of a counterweight and counterweight radius.

From European patent publication EP 1 925 586 B1 to Morath, a mobile crane is known in which individual limit curves or limit values are stored for various parameters of the crane, wherein the individual limit curves or limit values may not be exceeded to ensure the safety of the crane operation or only be exceeded if an alarm signal is given. Furthermore, the mobile crane has measures to ensure crane safety, which are configured to monitor the individual limit curves or limit values of the various parameters with respect to exceeding. One of the limit curves represents the relation of the boom strength to the geometric degrees of freedom of the boom or based on this relation.

European patent publication EP 1 025 585 A1 to Hoffman discloses a mobile crane with a rotatable boom, wherein a total center of gravity of the crane and one or more tilting lines are determined. The stability of the crane is monitored. A signal is output and/or further movement of the crane prohibited or changed if the distance between the total center of gravity and a tilting line approaches or reaches a threshold value and/or if the ratio of the distance between the total center of gravity and the rotating assembly center to the distance between the tilting line from the rotating assembly center approaches or reaches a threshold value.

European patent document EP 2 674 384 A1 to Ruoss discloses a method for monitoring crane safety of a crane with a variable support base and a monitoring unit. Several safety criteria during crane operation are monitored where an allowable specific limit value is calculated and monitored on compliance during crane operation for each criterion, which depends on at least one parameter concerning the crane configuration or crane movement during crane operation.

Thus, a need exists to overcome the problems with the prior art systems, designs, and processes as discussed above.

SUMMARY OF THE INVENTION

The systems, apparatuses, and methods described provide mobile cranes with variable support geometries that overcome the hereinafore-mentioned disadvantages of the heretofore-known devices and methods of this general type and that may indicate, for both operation planning as well as during operation of the crane, remaining degrees of freedom and geometric limits of boom adjustment to a crane operator and to graphically display them in a simple comprehensible manner.

With the foregoing and other objects in view, there is provided, a method for operating a mobile crane with a boom, comprising the steps of determining maximum permissible loads for a plurality of positions in predetermined position range of the boom, determining a load limit and/or one or more load ranges based on a suspended load and on the maximum permissible loads for the plurality of positions of the predetermined position range of the boom, and operating the mobile crane, depending on the load limit and/or the one or more load ranges.

An idea of the above method is, for operation planning or for operation of a mobile crane, to consider a plurality of possible positions of the boom in the predetermined position range of the boom as independently as possible from a current adjustment/movement direction of the boom and from the maximum permissible loads related thereto. This enables a more secure manipulation of the mobile crane and an improved operation planning while best exploiting the load range, i.e., under optimal utilization of the load capacity at each load position in the operational range, up to the load limits determined by the maximum permissible loads. In particular, the method allows the detection of those boom positions in which a local load limit has been reached or has been exceeded for the currently suspended load.

In accordance with another feature, the maximum permissible loads for the plurality of positions in the predetermined position range of the boom can be determined using a boom strength table and based on a support geometry of a support device. In particular, respective load limitations can be determined by the boom strength table, which defines load restrictions relevant for the boom strength, and by the support geometry for each of the plurality of positions of the boom. The maximum permissible loads may then be determined by the minimum of the load limits determined by the boom strength table and by the support geometry.

In accordance with a further feature, load limitations determined by the support geometry for the plurality of positions of the boom in the predetermined position range can be determined using a torque balance around one or more tilting lines defined by the support geometry.

In accordance with an added feature, the maximum permissible loads for different positions in the predetermined position range of the boom may be determined by load limitations determined by one or more load rating models that are map-based or function-based and, in particular, are dependent on one or more further parameters. In particular, the further parameters may represent limiting criteria, such as the maximum load of supporting cylinders, of the rotating assembly, of the derricking cylinder and of other crane parts on the superstructure that are in flow of forces of the boom and its displacement. The limiting criteria directly or indirectly result from the support geometry according to a known manner as can be seen by the aforementioned interrelations.

In accordance with an additional feature, in operation of the mobile crane, the plurality of positions of the boom in a given geometric surrounding of the current position of the boom may be considered to determine the maximum permissible loads, wherein an adjustment speed of the boom is selected, controlled and limited depending on a curve (i.e., a profile) of a load limit in the predetermined position range of the boom.

In accordance with yet another feature, the adjustment speeds of the boom in all directions can be controlled depending on a distance between the current load position and a load limit. The load limit corresponds to the positions of the load at which the suspended load reaches the maximum permissible load when it is moved in an adjustment direction. In particular, the adjustment speed may be controlled depending on a gradient of the curve of the maximum permissible load with respect to the adjustment direction.

In accordance with yet a further feature, the maximum permissible load for the predetermined position range of the boom can be displayed on a display for the predetermined position range as an absolute value indication or a relative value indication that indicates the ratio of the suspended load to the maximum permissible load. So, the crane operator can be provided with an indication about what extent he/she is allowed to bring a predetermined load from a predetermined safe start position, going along an uncritical direction, to at least one second, secure target position. The display can be any kind of computer display including, for example, an LED screen, an LCD screen, a plasma display, and an OLED display, and the display can be run by a stand-alone computer or one that is already present on the mobile crane.

Thus, an adjustment range display can be produced that provides to the crane operator, starting from the current position of the boom (at least defined by a rotation angle and a load radius), a representation of the surrounding of the load plumb. The representation of the surrounding allows one to instantly and visually perceive a position of the suspended load and a curve of other positions of the load at which the maximum permissible load is being exceeded, in the vicinity of the position of suspended load. In this way, a crane operator is enabled to instantly recognize potential remaining degrees of freedom of adjustment of the boom with its suspended load by viewing the representation of the surrounding on the display and, hence, to move the boom to other positions up to a safe limit of operation.

In accordance with yet an added feature, the absolute value indication or the relative value indication of the maximum permissible loads can be displayed on the display in a visually distinguishable manner, in particular, by a respective assigned coloring and/or brightness and/or shading. This type of display facilitates intuitive sensing the load curve in the entire operational range or in the immediate vicinity of the actual load position, respectively.

In accordance with yet an additional feature, the load ranges may indicate those positions of the boom or those load positions, respectively, where a ratio of the suspended load and the maximum permissible load is within a specified range.

In accordance with yet another additional feature, the determining step is carried out by determining at least one of a local load limit and one or more local load ranges.

With the objects in view, there is also provided a control unit for operating a mobile crane is provided with a boom, wherein the control unit is configured to determine maximum permissible loads for a plurality of positions in a predetermined position range of the boom, to determine a load limit and/or one or more load ranges based on a suspended load and on the maximum permissible load for the plurality of positions of the predetermined position range of the boom, and to operate the mobile crane depending on the load limit and/or the one or more load ranges.

With the objects in view, there is also provided a system for a mobile crane comprising the above control unit and a display that visually displays a representation to present maximum permissible loads in the predetermined position range of the boom as an absolute value indication or as a relative value indication for the plurality of positions of the boom in the predetermined position range, wherein the ratio of the suspended load to the maximum permissible load at a position of the boom is indicated.

With the objects in view, there is also provided a system for a mobile crane comprising the above control unit and a display that visually displays a representation to visually present, for the predetermined position range, the load ranges in the vicinity of a current load position corresponding to a current position of the boom.

In accordance with a concomitant feature, the display can be configured to present the load ranges as visually distinguishable areas, particularly, as areas that can be distinguished by their colors and/or by their patterns and/or by their brightness.

Although the systems, apparatuses, and methods are illustrated and described herein as embodied in mobile cranes with variable support geometries, they are, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems, apparatuses, and methods.

Additional advantages and other features characteristic of the systems, apparatuses, and methods will be set forth in the detailed description that follows and may be apparent from the detailed description or may be learned by practice of exemplary embodiments. Still other advantages of the systems, apparatuses, and methods may be realized by any of the instrumentalities, methods, or combinations particularly pointed out in the claims.

Other features that are considered as characteristic for the systems, apparatuses, and methods are set forth in the appended claims. As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one of ordinary skill in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the systems, apparatuses, and methods of the invention that are regarded as novel, it is believed that the systems, apparatuses, and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems, apparatuses, and methods. Advantages of embodiments of the systems, apparatuses, and methods will be apparent from the following detailed description of the exemplary embodiments thereof, which description should be considered in conjunction with the accompanying drawings in which.

DETAILED DESCRIPTION OF THE EMBODIMENTS

Figure 1A:
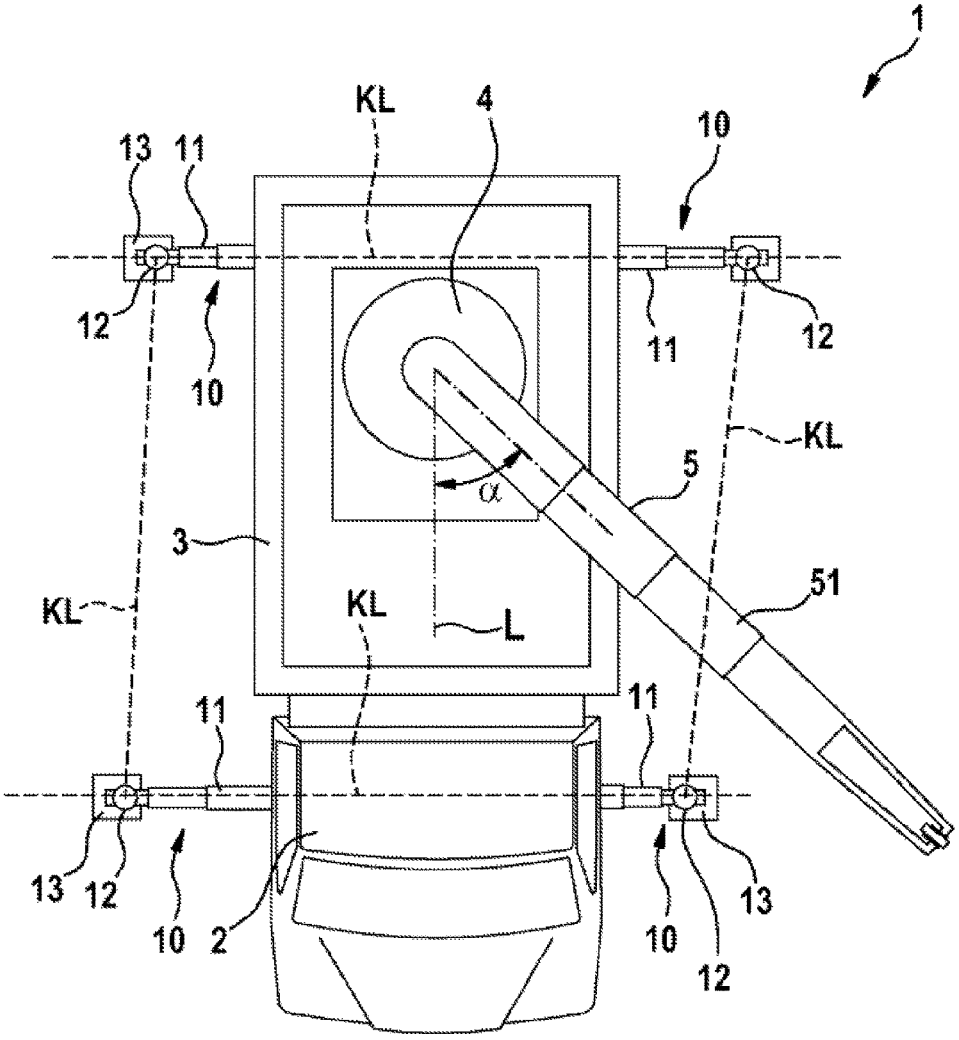
FIG. 1*a* is a diagrammatic top plan view of an exemplary embodiment of a mobile crane with a variable support base.

As required, detailed embodiments of the systems, apparatuses, and methods are disclosed herein; however, it is to be understood that the disclosed embodiments are merely exemplary of the systems, apparatuses, and methods, which can be embodied in various forms. Therefore, specific structural and functional details disclosed herein are not to be interpreted as limiting, but merely as a basis for the claims and as a representative basis for teaching one skilled in the art to variously employ the systems, apparatuses, and methods in virtually any appropriately detailed structure. Further, the terms and phrases used herein are not intended to be limiting; but rather, to provide an understandable description of the systems, apparatuses, and methods. While the specification concludes with claims defining the features of the systems, apparatuses, and methods that are regarded as novel, it is believed that the systems, apparatuses, and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems, apparatuses, and methods will not be described in detail or will be omitted so as not to obscure the relevant details of the systems, apparatuses, and methods.

Before the systems, apparatuses, and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, top/bottom, and proximal/distal. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. As used herein, the terms "substantial" and "substantially" means, when comparing various parts to one another, that the parts being compared are equal to or are so close enough in dimension that one skill in the art would consider the same. Substantial and substantially, as used herein, are not limited to a single dimension and specifically include a range of values for those parts being compared. The range of values, both above and below (e.g., "+/−" or greater/lesser or larger/smaller), includes a variance that one skilled in the art would know to be a reasonable tolerance for the parts mentioned.

It will be appreciated that embodiments of the systems, apparatuses, and methods described herein may be comprised of one or more conventional processors and unique stored program instructions that control the one or more processors to implement, in conjunction with certain non-processor circuits and other elements, some, most, or all of the functions of the devices and methods described herein. The non-processor circuits may include, but are not limited to, signal drivers, clock circuits, power source circuits, and user input and output elements. Alternatively, some or all functions could be implemented by a state machine that has no stored program instructions, or in one or more application specific integrated circuits (ASICs) or field-programmable gate arrays (FPGA), in which each function or some combinations of certain of the functions are implemented as custom logic. Of course, a combination of these approaches could also be used. Thus, methods and means for these functions have been described herein.

The terms "program," "software," "software application," and the like as used herein, are defined as a sequence of instructions designed for execution on a computer system or programmable device. A "program," "software," "application," "computer program," or "software application" may include a subroutine, a function, a procedure, an object method, an object implementation, an executable application, an applet, a servlet, a source code, an object code, any computer language logic, a shared library/dynamic load library and/or other sequence of instructions designed for execution on a computer system.

Herein various embodiments of the systems, apparatuses, and methods are described. In many of the different embodiments, features are similar Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 1B:
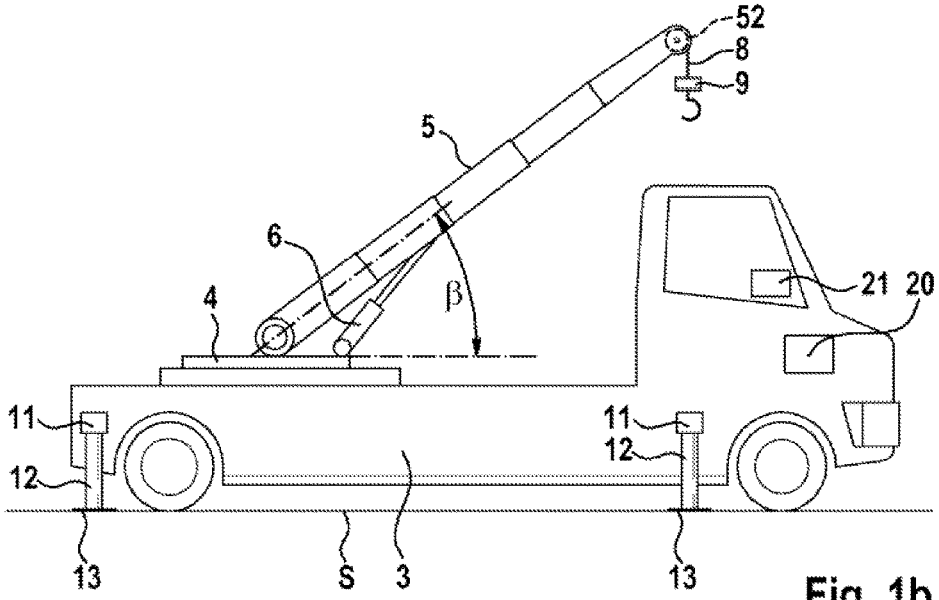
FIG. 1*b* is a diagrammatic side elevational view of the mobile crane of FIG. 1*a;*

Described now are exemplary embodiments. Referring now to the figures of the drawings in detail and first, particularly to FIGS. 1*a* and 1*b*, there is shown a first exemplary embodiment of a mobile crane 1. The mobile crane 1 has an operator's cab 2 and a crane superstructure 3 on which is disposed a rotating assembly 4 rotatable in a horizontal plane with an attached boom 5. The rotating assembly 4 permits a 360° rotation of the boom 5 attached thereon. A rotation angle $\alpha$ of the boom 5 can be set arbitrarily in the entire rotation range of the boom 5. In one exemplary embodiment, on the crane superstructure 3, a counterweight can be mounted at the rotating assembly 4 (not shown here), which is disposed on an opposite side with respect to the boom.

Furthermore, a hydraulic derricking cylinder 6 is placed on the rotating assembly 4 through which it is possible to control a derricking angle $\beta$ of the boom 5, i.e., a vertical angle perpendicular to the horizontal plane.

In addition, the boom can be provided 5 with boom segments (boom boxes) 51, which may be telescopically displaced to set or control a length of the boom 5 by retracting or extending the boom boxes 51 depending on a desired boom configuration. At the upper end of the boom 5, a pulley 52 is provided for guiding a load rope 8, at the end of which a hook 9 is provided, to which a load can be suspended.

In the area of the front and rear corners of the mobile crane 1 supports 10 (e.g., four) are provided. The supports 10 each have an extensible support extension 11, which can be telescoped in and out by a plurality of sliding extension cylinders. The support extensions 11 can be extended in a plane, which is defined by non-illustrated wheel axles or may extend in parallel to the footprint S of the mobile crane, respectively (the footprint being the area of the ground covered by the mobile crane).

A supporting cylinder 12 is respectively located on a distal end of the support extensions 11 of the mobile crane 1 which can be extended towards a footprint S of the mobile crane 1. At each end of the supporting cylinders 12, a support plate 13 is located, which is placed on the footprint S of the mobile crane 1, so that the supports 10 support the mobile crane 1 on the ground.

To determine a maximum permissible load of the mobile crane 1, boom strength tables are used, which indicate a load limitation with respect to a boom stability depending on a configuration, i.e., the selected length of the boom 5 and the extended boom segments 51 and depending on the load radius. The boom strength tables define map-based limits for the suspended load, which must not be exceeded or only be exceeded by outputting a warning signal. From the boom strength tables, it can be determined whether the suspended load is less than, equal to, or greater than the maximum permissible load determined by the boom stability.

In limited areas for positioning of the mobile crane 1, the support extensions 11 may not be fully extended in some circumstances. This results in not being able to reach a maximum allowed load that would be reached at a maximum extension of support extensions 11. Thus, the maximum permissible load of the mobile crane 1 is generally determined not only on the basis of the boom stability indicated by the boom strength table and on restrictions determined with respect to other parameters, but also significantly based on a load limitation, which is determined by the support geometry of the support positions defined by the support cylinders 12.

In addition to boom stability, one or more additional parameters, in particular, the maximum cylinder pressure of the derricking cylinder 6 and/or the supporting cylinder 12, the load capacity of the load rope 8, the strength of rotating assembly 4, and the like, can cause or provide respective load limitations by function-based load calculations as restrictions/limitations for the permissible suspended load. So, possibly by calculation of the minimum of the determined load limitations, the maximum permissible load may be limited to a total value that may be less than the value of the load limitation defined by the boom stability.

A significant, reducing impact on the maximum permissible load can be given by not fully extended support extensions 11 of the supports 10. The respective length of extension of the support extensions 11 defines the four (or possibly three) support positions of the support cylinders 12, on which the entire weight of the mobile crane 1 including its load usually rests. The connection lines between the support positions form a so-called support geometry that is defined by tilting lines KL. The tilting lines KL represent the linear connections between two adjacent support positions of supports 10 and thereby determine possible axes about which the mobile crane 1 can fall over in case of overload. The smaller the distance between the center of mass of the mobile crane 1 and the tilting line KL, the less is the maximum permissible load determined by the supporting geometry.

Starting from the predetermined boom load capability, which is defined by the boom strength table, as well as the map-based or function-based load restrictions for other parameters, such as the capacity of the derricking cylinder 6, the load capacity of the supporting cylinders 12, the loading capacity of the rotating assembly, etc. a load limitation, i.e., a maximum permissible load for a particular load position can be determined depending on the tilting lines KL determined by the support geometry and on the respective boom position (defined by rotation angle $\alpha$ and a derricking angle $\beta$).

This calculation can include determining a torque balance around the tilting line KL for different load positions. Specifically, a distance between the load position that corresponds to a projection of the three-dimensional spatial position of a suspended load on the substantially horizontal footprint S of the mobile crane 1, and the relevant tilting line KL or the relevant tilting lines KL. The relevant tilting lines are determined in that an outwardly acting torque about the respective tilting line is effected by the suspended load (with respect to the area enclosed by the tilting lines KL). The calculation of the distance between the projected load position and the tilting line can be performed by trigonometric functions as it is well known in the art. From the suspended load and the distance between the projected load position on the substantially horizontal footprint S and the critical tilting line KL, a load tilting torque can be determined in a known manner.

Further, a value of a stability torque defined by the own weight of the mobile crane 1 is determined with respect to the defined support positions or to the tilting lines KL calculated in the mobile crane 1. Also, a distance between a center of mass of the mobile crane 1 and the relevant tilting lines KL can be determined by known functions, such as trigonometric functions, so that the stability torque can be calculated by a product of the weight of the mobile crane 1 and the distance of the center of mass from of the respective tilting line KL of the support geometry.

In particular, a difference between the load tilting torque and the stability torque determines the stability of the mobile crane 1. The load limitation of the mobile crane 1, primarily defined by the boom position and the support geometry, at a certain position (at least defined by rotation angle and derricking angle) of the boom 5 is determined in that the difference between the load tilting torque and the stability torque at a certain support geometry is zero or, providing a predetermined tolerance, a certain predetermined value. Thus, a curve of the load limitation, which may be determined by an existing support geometry and through an existing configuration of the mobile crane 1, is determined for positions of the boom 5 dependent upon the rotation angle $\alpha$ and the derricking angle $\beta$.

In summary the total maximum permissible load may be determined by:

- a load limitation that depends on the support geometry;
- the load limitation specified by the boom stability based on the boom strength table; and
- the one or more function-based load limitations based on the other parameters and optionally with respect to further limiting parameters such as the capacity of the derricking cylinder, the capacity of the supporting cylinders 12 depending on the respective support geometry, the stability of the rotating assembly, and the like.

The maximum permissible load can be determined by calculating a minimum of such individually determined load limitations for the particular position of the boom 5.

During crane operation, whether the currently suspended load at the current position of the boom exceeds the estimated total maximum permissible load is monitored by calculating the minimum of total maximum permissible load.

By determining the maximum permissible load for a plurality of load positions in the geometric surrounding of the actual load position, a further monitoring can be performed so that an adjustment (i.e., movement) of the boom 5, at least in a critical direction (while the maximum permissible load is reducing) or is slowed down or inhibited and/or a warning signal is output as soon as the load on the boom reaches, exceeds, or approaches a critical limit of the maximum permissible load.

On the mobile crane 1, a controller or control unit 20 is provided to perform the monitoring function and the described determination of the maximum permissible loads, based on the individually determined load limitations. This control unit 20 may be implemented in the general crane controller or may be configured as a standalone controller.

To carry out the calculation, the control unit 20 is coupled to various non-illustrated sensors to obtain the actual position of the supporting cylinders 12 based on the extended length of the support extensions 11, the rotation angle $\alpha$ of the boom 5, the derricking angle $\beta$ of the boom 5, and the weight of the suspended load. Based on these data and on geometric specifications, such as the position of the center of mass of the unloaded mobile crane 1 and the current configuration, in particular, the boom configuration, the control unit 20 can perform the calculations to determine the maximum permissible load.

The control unit 20 performs calculations in calculation cycles of a few milliseconds. Thereby, for monitoring several positions of the boom 5, the respective maximum permissible loads are cyclically determined for positions of the boom in a predetermined position range according to the above calculation scheme. For each of the considered positions of the boom 5, the resulting load limits depending on the respective positions of the boom 5 (with respect to boom stability, support geometry and with respect to one or more of the further and/or limiting parameters) are determined and linked by a minimum operation to obtain the total maximum permissible loads for the respective positions of the boom 5.

The monitoring function of the control unit 20 can now be carried out based on the current position of the boom 5 (and the current load position, respectively), the suspended load, and the maximum permissible loads for the positions of the boom 5 in the predetermined position range. The local curve of the load limit corresponds to those positions of the boom 5 and those positions of the load, respectively, at which the currently suspended load is equal to the maximum permissible load. For example, the monitoring can cause a slow down, a limit, an enable, or an inhibition of a desired adjustment of the boom 5 depending on whether the load approaches to or moves away from the load limit.

In an exemplary embodiment, the control unit 20 is provided with a display device 21 to provide visual information on a display 22 on the maximum permissible load and the curve of the load limit to a crane operator for use in operation planning and in operation of the mobile crane 1. This visual information can be related to one or more portions of possible adjustments and/or positions of the boom 5. In such a case, for operation planning at a current position of the boom 5 and a current crane configuration, the respective maximum permissible load in the range of possible load positions can be displayed to the crane operator as an absolute value. In particular, the positions of respective maximum permissible load can be indicated as a distance from a boom pivot axis.

Figure 2:
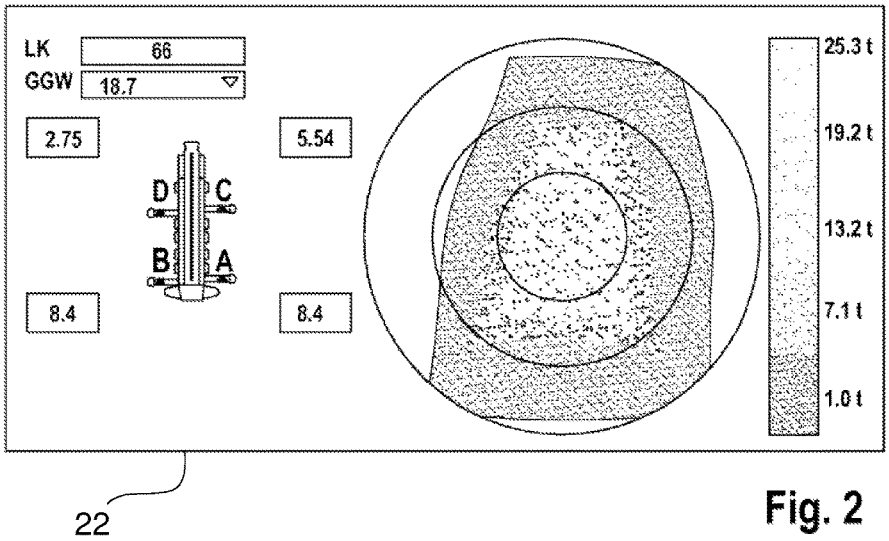
FIG. 2 a graphical representation of an exemplary embodiment of a display of a maximum permissible load of a boom in an entire surrounding area of the mobile crane of FIG. 1*a;*

A presentation of the curve of the maximum permissible loads may, e.g., be given by a display, as shown in the display 22 of FIG. 2. FIG. 2 shows, for various positions of the suspended load around the boom axis of rotation, the value of the maximum permissible load in different colors, brightness, or shading. For each position of a load, it can be seen the local load-bearing capacity, i.e., the maximum permissible load, based on the coloring, brightness or shading graphically displayed, so that a crane operator may simply carry out an operation planning according to its lifting schedule.

Figure 3:
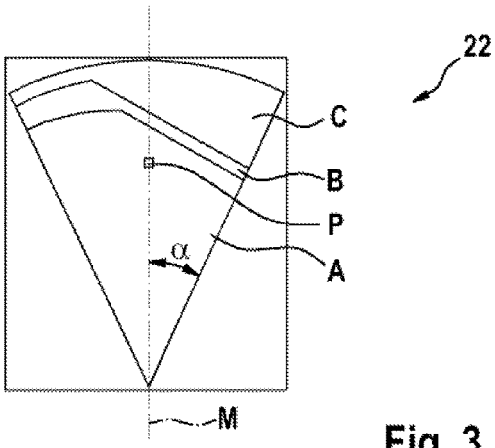
FIG. 3 a graphical representation of an exemplary embodiment of a portion of a display of a surrounding area of a position of a load suspended on the boom and non-critical, critical, and impermissible load ranges in the surrounding area.

FIG. 3 shows a segmented view of area surrounding a current load position P based on the current load position as a further optional possibility of presentation. For example, starting from the current rotational angle position of the boom 5, an angular range of ±30° of the rotation angle $\alpha$ (differing angular spaces are also possible) and the entire radial range in a segment display presentation. The radial range is determined by the effective boom length based on the actual boom length and the possible derricking angle (derricking angle between the minimum and maximum possible derricking angles). However, other radial ranges are possible, too. Desirably, they should include the current load position and the curve of the load limit, indicating the reaching or exceeding the maximum permissible load by the currently suspended load.

The segmented presentation shows the current load position P on a central axis M as a label and different load ranges that represent the possible load positions in the geometric vicinity of the current load position P by color differentiation. In the illustrated embodiment, three load ranges are shown:

- a first load range A in which the suspended load is significantly smaller than the maximum permissible load;
- a second load area B in which the suspended load approximately corresponds to the maximum permissible load; and
- a third load range C in which the suspended load is equal to or more than the maximum permissible load.

The load ranges are defined by the profiles of the load limit with respect to the load bearing capacity.

The first load range A can indicate a load range of load positions, in which the currently suspended load is below a predetermined portion of the maximum permissible load such as 90% of the maximum permissible load, by a green coloring. So a second (critical) load range B can indicate a critical range of load positions, in which the suspended load approximately reaches the maximum permissible load (for example, between 90% and 100% of the maximum permissible load) for example, by a yellow color. An adjacent third (impermissible) load range C may indicate, for example, by a red color, the range of load positions in which the currently suspended load would exceed the maximum permissible load or in which the stability of the crane caused by its own weight (e.g., rear stability) cannot be guaranteed. The boundary between the second load range B and the third load range C corresponds to the load limit.

The control unit 20 calculates the corresponding maximum permissible loads for each current load position and for the positions of the boom 5, corresponding to the possible load positions that surround the current load position, and determines the corresponding portion of the currently suspended load. This portion is displayed in a segmented presentation depending on a position in an appropriate manner by a flat visual design etc.

This allows the crane operator to realize at any time and in any state of the mobile crane 1 what distance is between the current load position and a boundary defined by the maximum permissible loads (i.e., a limit that is defined by reaching or by exceeding the maximum permissible load by the suspended load) so that he/she can assess which adjustments of the boom 5 are allowed and which cause a critical approach to a load position at which the suspended load corresponds to the maximum permissible load.

If the position of the suspended load is in the second (critical) load range B, each actuation of the boom 5, which would move the load farther to a load position in which the maximum permissible load is reduced, can be executed by the control unit 20 more slowly and/or be inhibited by the control unit 20 when reaching the load limit. In contrast thereto, actuations in adjustment directions of the boom 5, which would move the load back into the first (non-critical) load range of boom positions, can be executed by the control unit 20 in an unchanged manner.

In general, the control unit 20 can control an adjustment speed of the boom in the predetermined position range of the boom 5 depending on the curve of the load limit, which indicates the positions of a suspended load at which the maximum permissible load of the mobile crane 1 exceeded by the suspended load. In particular, the adjustment speed of the boom 5 can be controlled depending on its suspended load and depending on a distance between a load position of the suspended load and a position at which the suspended load reaches a maximum permissible load. Alternatively or additionally, the adjustment speed can be controlled depending on a gradient of the curve of the maximum permissible load with respect to the adjustment direction. In addition, the adjustment speed can be reduced depending on the ratio of the load to the maximum permissible load at the current load position.

In particular, the adjustment speed can be reduced with respect to the operator's request or limited to an adjustment speed desired by the user adjustment if the gradient of the curve of the maximum permissible load in a direction of the desired adjustment is relatively large (e.g., larger than a predetermined threshold) and a distance to the load limit has fallen below a minimum distance. Control of the adjustment speed dependent upon the gradient of the curve of the maximum permissible load in the direction of the desired adjustment movement has the advantage that the load limit is approached so slowly that an overshoot of the boom 5 or the suspended load, respectively, over the load limit may be prevented.

Figure 4:
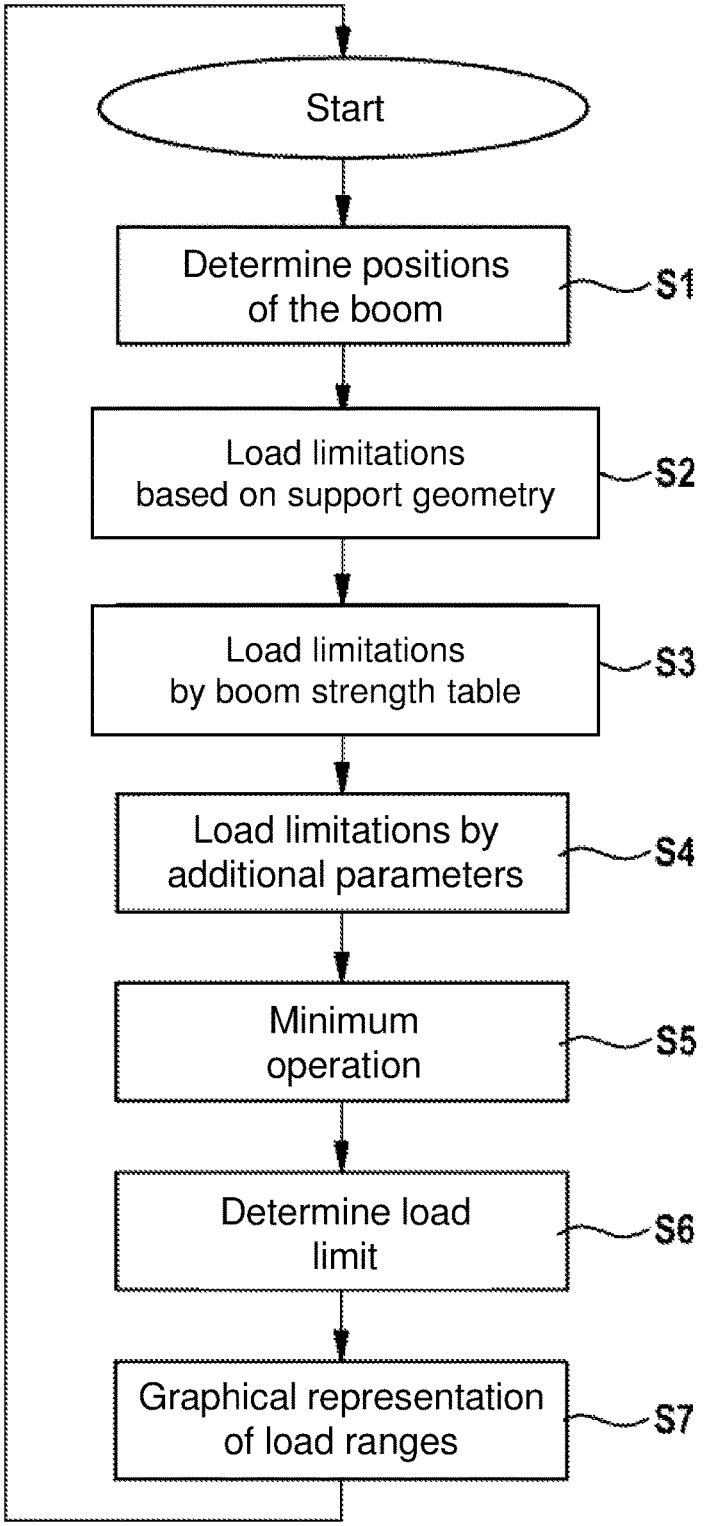
FIG. 4 a flowchart illustrating an exemplary method for determining a maximum permissible load and a load limit and for outputting a representation of load ranges surrounding a current load position.

FIG. 4 shows a flowchart for illustrating an exemplary embodiment of a method for operating the mobile crane 1.

In step S1, a current position of the boom 5 and the current load position are determined. Based on the current load position, further positions of the boom 5 are defined indicating a surrounding area of possible load positions around the current load position.

In step S2, depending on a supporting geometry, respective load limits are determined for the current position of the boom 5 and the further positions of the boom 5.

In a subsequent step S3, a load limitation indicated by a boom stability is determined for the current position of the boom 5 and for each of the other positions of the boom 5 based on a boom strength table, and in step S4, the one or more function-based load limitations are each determined based on the other parameters, and optionally with respect to other limiting parameters.

In step S5, the maximum permissible loads are determined for the current position of the boom 5 and for the further positions of the boom 5 by performing a minimum operation with the load limitations.

In step S6, those positions of the boom 5 are taken from the above defined positions of the boom 5 at which the suspended load reaches or exceeds the maximum permissible load. These positions of the boom 5 define the load limit.

In step S7, the load positions corresponding to the predetermined positions of the boom 5, are assigned to load ranges and, as described above, visually displayed. The visual presentation may comprise the representation of absolute values of the maximum permissible load for the entire load range and/or the segmented presentation for illustrating the surrounding of the load position with respect to the load limit. In particular, in the segmented presentation, load ranges are distinguished by different visual designs, so that a user may intuitively see permissible crane adjustments for the suspended load.

It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems, apparatuses, and methods. However, the systems, apparatuses, and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems, apparatuses, and methods as defined by the following claims.

What is claimed is:

1. A method of operating a mobile crane with a boom, comprising the steps of:

determining maximum permissible loads for a plurality of positions in a predetermined position range of the boom;

determining at least one of:

a load limit; and one or more load ranges;

based on a suspended load and on the maximum permissible loads for the plurality of positions of the predetermined position range of the boom; and operating the mobile crane dependent upon at least one of the load limit and the one or more load ranges, wherein the maximum permissible loads for the plurality of positions in the predetermined position range of the boom are determined using a boom strength table and are based on a support geometry of supports of the mobile crane and the maximum permissible loads are then determined by a minimum operation applied on the load limits determined by the boom strength table and by the support geometry.

2. The method according to claim 1, wherein respective load limitations are determined by the boom strength table and by the support geometry for each of the plurality of positions of the boom and the maximum permissible loads are then determined by a minimum operation applied on the load limits determined by the boom strength table and by the support geometry.

3. The method according to claim 1, wherein load limitations determined by the support geometry for the plurality of positions of the boom in the predetermined position range are determined using a torque balance around one or more tilting lines defined by the support geometry.

4. The method according to claim 3, wherein the maximum permissible loads for different positions in the predetermined position range of the boom are determined by means of load limitations determined by one or more load rating models which are map-based or function-based or dependent on one or more further parameters.

5. The method according to claim 1, wherein the maximum permissible loads for different positions in the predetermined position range of the boom are determined by load limitations determined by one or more load rating models that are map-based or function-based or dependent on one or more further parameters.

6. The method according to claim 1, wherein the maximum permissible loads for the predetermined position range of the boom are displayed on a display for the predetermined position range as an absolute value indication or a relative value indication that indicates a ratio of the suspended load to the maximum permissible load.

7. The method according to claim 6, wherein the absolute value indication or the relative value indication of the maximum permissible loads are displayed on the display in a visually distinguishable manner.

8. The method according to claim 6, wherein the absolute value indication or the relative value indication of the maximum permissible loads are displayed on the display with a respectively assigned distinction selected from at least one of color, brightness, and shading.

9. The method according to claim 1, wherein the load ranges indicate those positions of the boom or those load positions, respectively, where a ratio of the suspended load and the maximum permissible load is within a specified range.

10. The method according to claim 1, which further comprises carrying out the determining step by determining at least one of:

a local load limit; and one or more local load ranges.

11. A method of operating a mobile crane with a boom, comprising the steps of:

determining maximum permissible loads for a plurality of positions in a predetermined position range of the boom;

determining at least one of:

a load limit; and one or more load ranges;

based on a suspended load and on the maximum permissible loads for the plurality of positions of the predetermined position range of the boom; and operating the mobile crane dependent upon at least one of the load limit and the one or more load ranges, wherein, in operation of the mobile crane:

the plurality of positions of the boom in a given geometric surrounding of a current position of the boom is considered in order to determine the maximum permissible loads; and an adjustment speed of the boom is selected dependent upon a curve of a load limit in the predetermined position range of the boom.

12. The method according to claim 11, wherein the adjustment speed of the boom is controlled dependent upon a suspended load and a distance between a current load position and the load limit, the load limit corresponding to the positions of the load at which the suspended load reaches the maximum permissible load if it is moved in an adjustment direction.

13. The method according to claim 12, wherein the adjustment speed is controlled dependent upon a gradient of a curve of the maximum permissible load with respect to the adjustment direction.

14. A system for a mobile crane having a boom, comprising:

a controller for operating the crane comprising:

a control unit configured to:

determine maximum permissible loads for a plurality of positions in a predetermined position range of the boom;

determine at least one of:

a load limit; and one or more load ranges, based on a suspended load and on the maximum permissible loads for the plurality of positions of the predetermined position range of the boom; and operate the mobile crane dependent upon at least one of the load limit and the one or more load ranges; and a display device configured:

to visually present a display that shows, for the predetermined position range, the load ranges in a vicinity of a current load position corresponding to a current position of the boom; and to present the load ranges as visually distinguishable areas.

15. A system for a mobile crane, comprising:

the control unit according to claim 14; and a display device configured to visually present a display that shows present maximum permissible loads in the predetermined position range of the boom as an absolute value indication or as a relative value indication for the plurality of positions of the boom in the predetermined position range, the relative value indication defining a ratio of the suspended load to the maximum permissible load at a position of the boom.

16. The system according to claim 14, wherein the display device is configured to present the load ranges as areas that can be distinguished by at least one of color and brightness.

* * * * *